US006161318A

United States Patent [19]

Cunningham

[11] Patent Number: 6,161,318

[45] Date of Patent: Dec. 19, 2000

[54] DRIVE-BY RESTAURANT ORDER STAND WITH ILLUMINATED ROTATING MENU

[76] Inventor: William B. Cunningham, P.O. Box 25463, Oklahoma City, Okla. 73125

[21] Appl. No.: 09/277,547

[22] Filed: Mar. 29, 1999

[51] Int. Cl.[7] ..... G09F 13/00

[52] U.S. Cl. ..... 40/502; 40/431; 40/572; 40/573

[58] Field of Search ..... 40/473, 502, 506, 40/564, 568, 572, 573, 575, 430, 431; 362/812; D20/19

[56] References Cited

U.S. PATENT DOCUMENTS

| | | | |
|---|---|---|---|
| D. 326,477 | 5/1992 | Cunningham | D20/19 |
| D. 348,285 | 6/1994 | Cunningham | D20/19 |
| D. 366,502 | 1/1996 | Durco, Jr. | D20/19 |
| 2,167,563 | 7/1939 | Castillón | 40/502 |
| 3,068,599 | 12/1962 | Myerson | 40/572 |
| 3,399,476 | 9/1968 | Davis | 40/473 X |
| 3,537,198 | 11/1970 | Barrett | 40/502 |
| 5,682,694 | 11/1997 | Hillstrom | 40/568 X |

*Primary Examiner*—Brian K. Green
*Attorney, Agent, or Firm*—Robert K. Rhea

[57] ABSTRACT

A drive-by restaurant illuminated rotating menu order stand is formed by an upright housing having a translucent part-circular wall end portion and is mounted on a support by an opposite bifurcated end wall. A menu supporting cylinder axially mounted upright in the part-circular end is angularly rotated by a motor. Lamps within the housing and cylinder illuminate the menu and housing.

4 Claims, 3 Drawing Sheets

DRIVE-BY RESTAURANT ORDER STAND WITH ILLUMINATED ROTATING MENU

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to fast food restaurants and more particularly to a customer order stand having an illuminated rotating menu.

1. Field of the Invention

Fast food restaurants are conventionally provided with a customer order stand mounted on a support post at a height convenient for access by the driver of a vehicle when placing an order to be picked up at a customer service window.

2. Description of the Prior Art

U.S. Pat. No. Des. 326,477 issued May 26, 1992 to Cunningham for Customer Operated Visual Responsive Order Stand For Drive-Through Restaurants is believed to be a good example of the state-of-the-art for drive-by restaurant order stands.

SUMMARY OF THE INVENTION

A generally rectangular in side elevation order stand is characterized by a part-cylindrical vertical surface at one end, and a bifurcated opposite end for straddle mounting attachment with the upper end portion of a support post. The side walls of the stand support vertical panels which may contain advertising or menus and features an angularly rotated illuminated cylinder within the part-cylindrical end portion for visual inspection by customers of a menu printed on or supported by the exterior of the rotating cylinder.

The principal object of this invention is to provide a drive-by restaurant order stand which, in addition to being internally illuminated, is provided with an angularly rotated cylinder containing a restaurant menu.

DETAILED DESCRIPTION OF THE INVENTION

Figure 1:
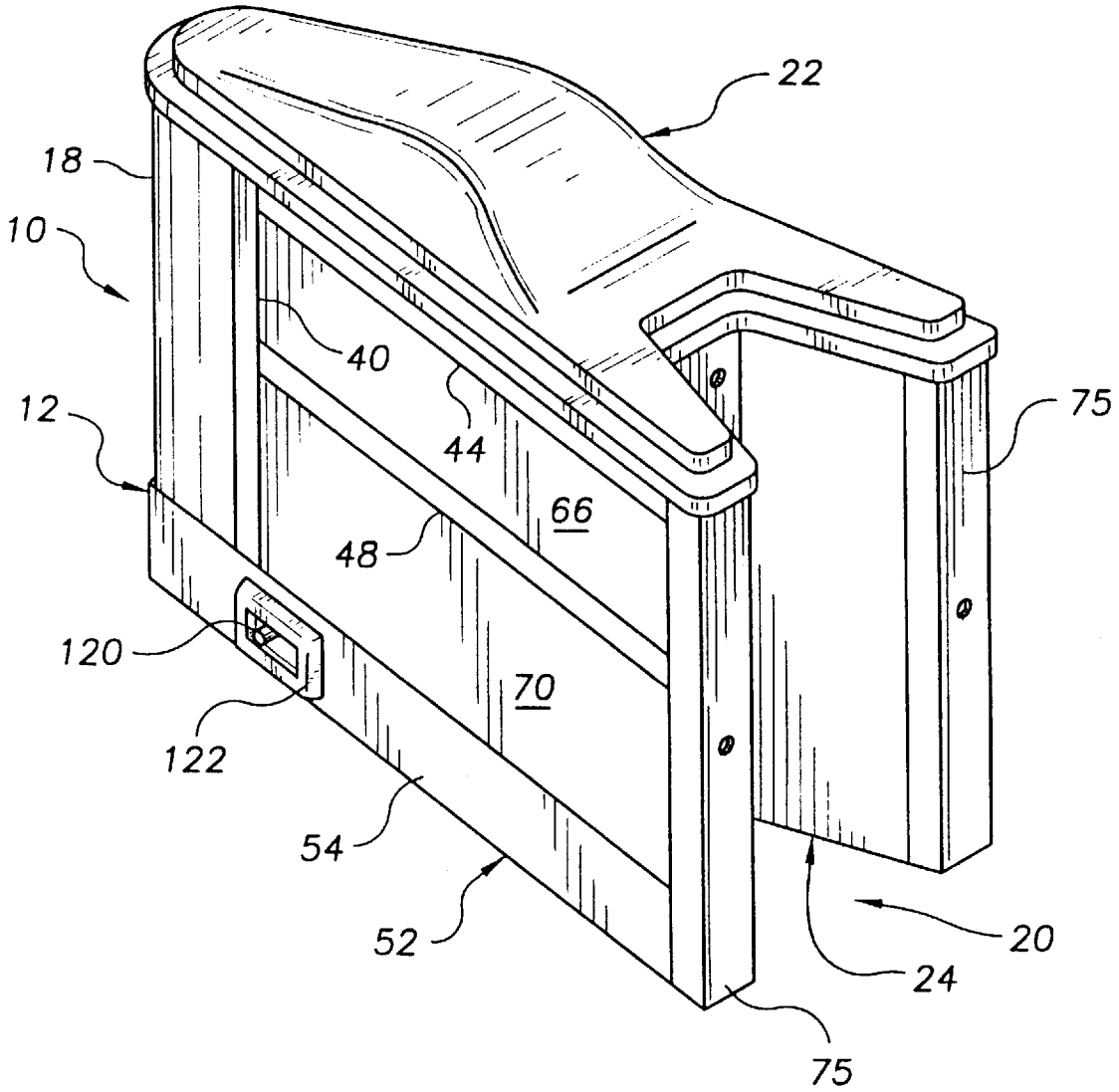
FIG. 1 is a perspective view of the order stand per se.

Referring first to FIG. 1, the reference numeral 10 indicates the stand as a whole comprising a hollow housing means 12 having opposing generally planar sides 14 and 16; a part-cylindrical end 18, an opposite bifurcated end 20; and a cover or top 22.

The housing means 12 includes a frame means having an upright rearward end member 24 substantially U-shaped in transverse section, having a forwardly disposed planar bight portion 26, and rearwardly diverging legs 28 and 30 terminating in laterally extending foot portions 32 and 34. A horizontal floor 36, having forwardly converging side edges, and similarly having a bifurcated end portion conforming to the configuration of the frame end member 24, is secured to the frame members in spaced relation with respect to the depending limit of the frame end member 24. The forward end of the floor 36 is arcuately curved on a selected radius complemental with the part-circular end portion 18.

A transverse partition wall 38 is rigidly secured to upper surface of the floor 36 in rearward spaced relation with respect to the forward arcuate end portion 18 and terminates upwardly in the horizontal plane of the upper limit of the frame rearward wall 24. A pair of frame strap-like forward standards 40 and 42, each having substantially coextensive forward and rearwardly open slots (not shown), are respectively secured to the lateral upright edges of the partition wall 38.

Figure 2:
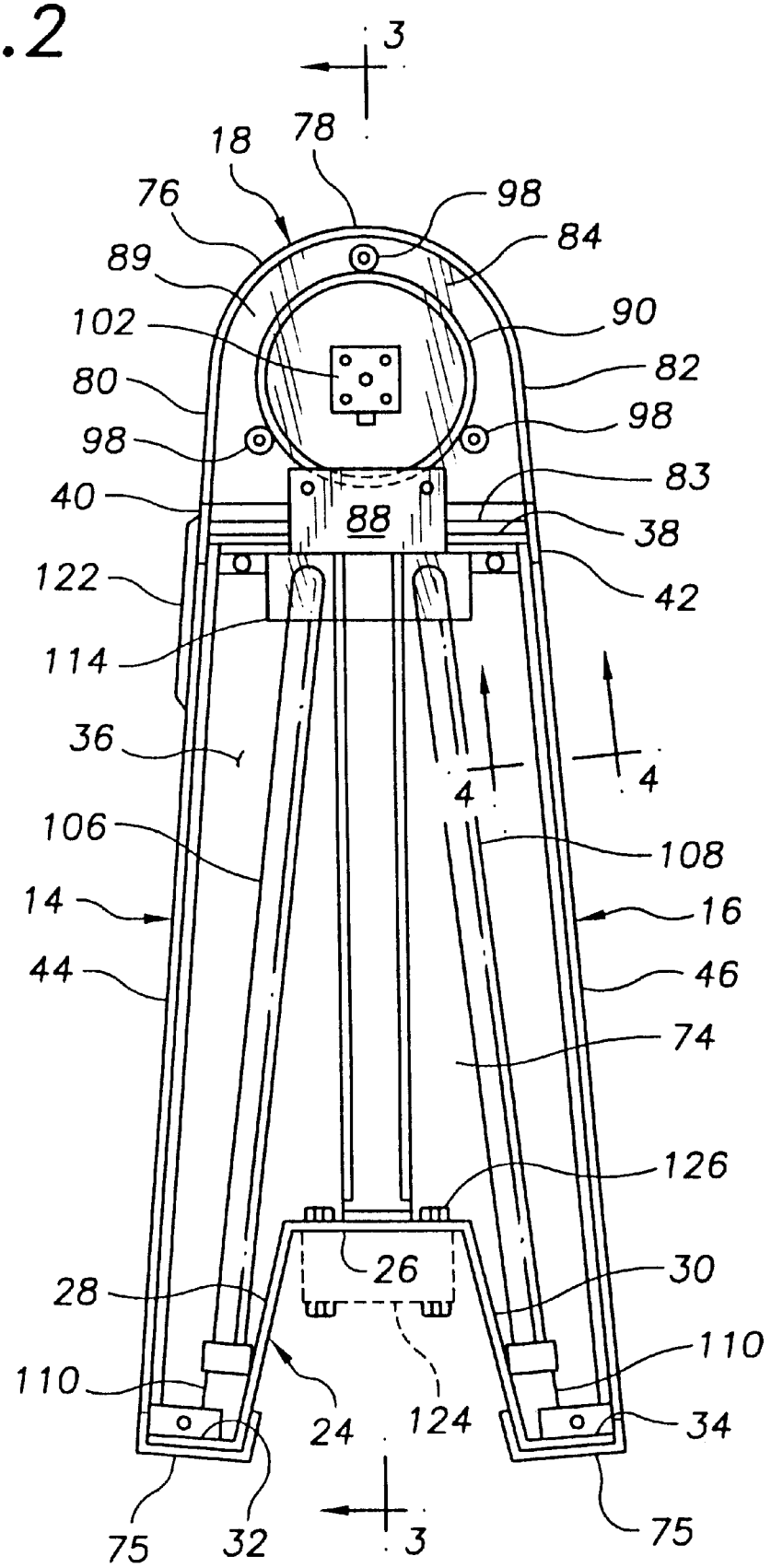
FIG. 2 is a top view to a larger scale, with the top removed and illustrating by broken lines the relative position of a support post.
Figure 4:
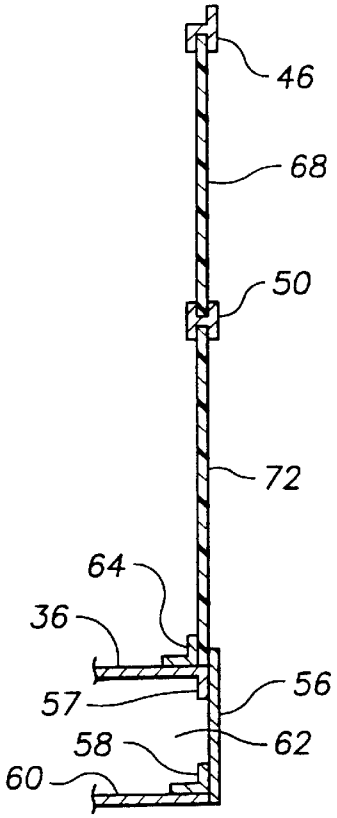
FIGS. 3 and 4 are vertical cross sectional views to an enlarged, scale taken substantially on the lines 3—3 and 4—4 respectively of FIG. 2.
Figure 3:
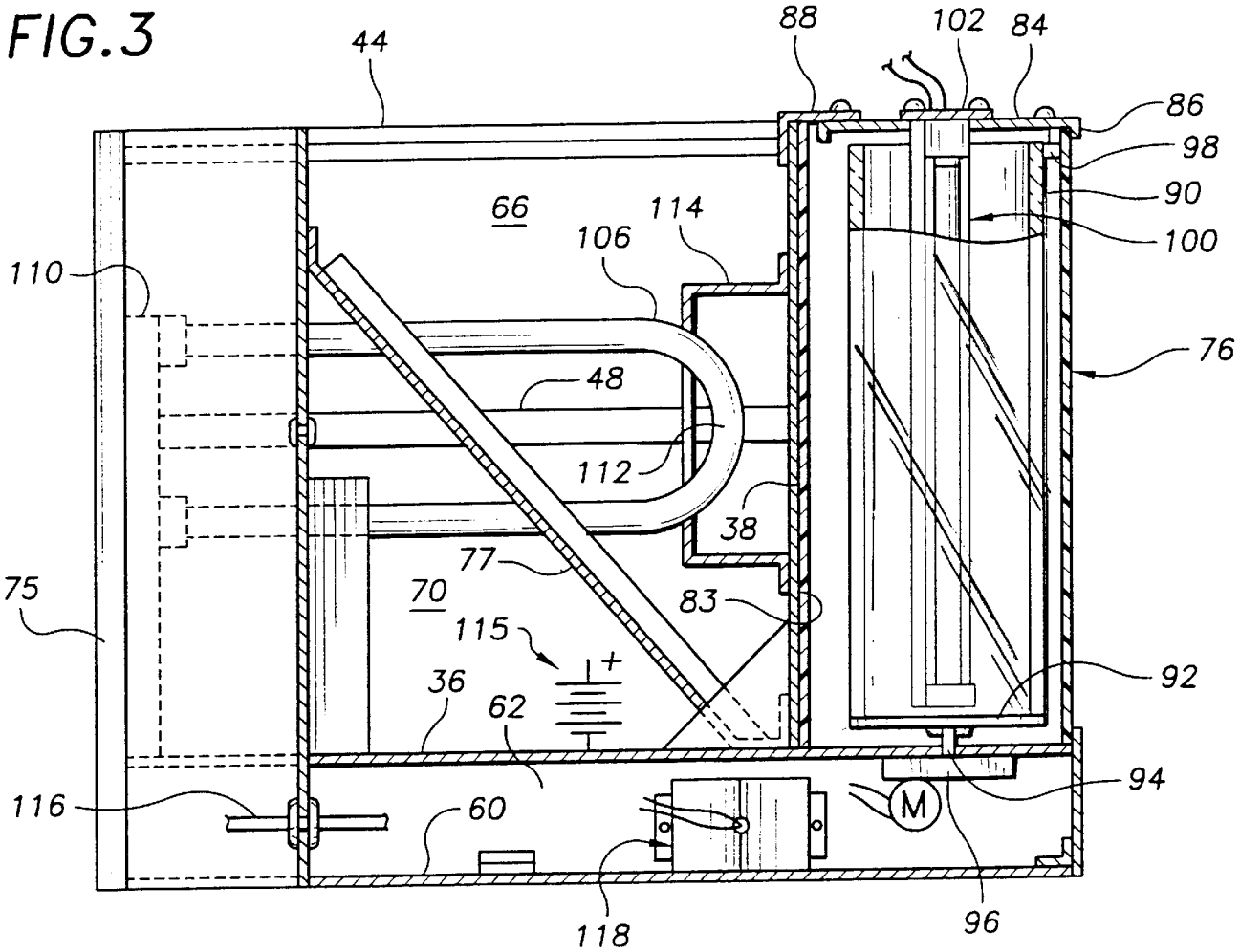

Frame side wall top rails 44 and 46 extend horizontally forward between the rearward foot members 32 and 34 and the frame standards 40 and 42. The top rails 44 and 46 each have a downwardly open coextensive channel-like slot (FIG. 4) for the purposes presently explained. Intermediate, substantially H-shaped, frame rails 48 and 50 extend horizontally in downward spaced relation between the respective frame rearward member foot portions 32 and 34 and the frame standards 40 and 42. A horizontal bottom rail 52, generally U-shaped in top view (FIG. 2), having a forward part-circular end portion complemental with the arcuate configuration of the end portion 18 and floor 36 forward edge and having rearwardly projecting leg members 54 and 56 is connected with the forward and lat5 eral edges of the floor 36 by a depending floor flange 57 (FIG. 4). A right angle member 58, secured to the inner depending edge portion of the bottom rail 52, anchors a housing bottom 60 to the bottom rail 52 thus forming an equipment compartment 62 below the floor 36. An angle member 64 on the top peripheral edge portion of the floor 36 forms an upwardly open slot with the respective leg of the bottom rail 52 confronting the lowermost slot of the H-shape respective intermediate rail 48 and 50. Upper and lower pairs of plastic material sidewall panels 66–68, and 70–72 are respectively removably received slidably by the confronting slots of the top, intermediate, forward and bottom rails, thus completing a lamp compartment 74. A pair of channel shaped housing end caps 75 are vertically secured to the feet of the rearward bifurcated member 24 to provide a finished appearance for the side walls 14 and 16. A channel shaped brace 77 extends angularly downward and forwardly between the upper forward surface of the bight portion 26 and the lower limit of the partition 38 adjacent the upper surface of the floor 36, medially the width of the housing.

The part-circular end portion 18, supported by the floor 36, includes a U-shaped wall 76, preferably translucent material, having a bight portion 78 and legs 80 and 82 terminating in the respective forward slot of the frame standards 40 and 42 forwardly of the partition wall 38. A translucent panel 83 coextensive with the perimeter of the partition wall 38 is flatly disposed adjacent the forward surface of the partition wall 38. The upper forward edge portion of the bottom rail 52 overlaps the depending edge portion of the wall 76.

A lid 84, preferably formed from transparent material, overlies the upper limit of the U-shaped wall 76 and includes a depending flange 86 overlapping the upper arcuate edge portion of the U-shaped wall 76 and forms a menu compartment 89. The transparent lid 84 is secured by an L-shaped flap 88 rigidly connected with the rearward surface of the partition wall 38 and anchored by its horizontal portion to the rearward limit of the lid 84.

A sleeve-like cylinder 90 having a radius less than the radius of the bight portion 78, and an overall length less than the spacing between the top surface of the floor 36 and the depending limit of the lid 84, is axially positioned within the menu compartment 89. The cylinder 90 is provided with a bottom wall 92 axially mounted on a shaft 94 projecting upwardly through the floor 36 from a transmission 96 driven by a motor M for angular rotation of the cylinder 90.

The cylinder is maintained substantially coaxial with the shaft 94 by a plurality of bearings 98 circumferentially spaced about the perimeter of the cylinder upper end portion and journaled by pins projecting downward through the lid 84. The purpose of the rotating cylinder 90 is to receive restaurant menu items placed on its periphery to be visually observed by a customer with the reading thereof enhanced by a florescent lamp assembly means 100 axially projecting downwardly into the cylinder 90 from a mounting plate 102 on the lid 84.

The lamp compartment 74 contains a pair of conventional U-shaped fluorescent lamps 106 and 108 respectively mounted by lamp brackets 110 secured to the forward limit of the frame rearward end member legs 28 and 30. The lamps 106 and 108 converge forwardly toward the partition wall 38 on opposite sides of the brace 77. The respective lamp bight portion 112 is supported by a transparent material bracket 114 secured to the rearward surface of the partition wall 38.

A source of electrical energy 115 is connected through conventional controls by wiring 116 for energizing the lamps 100, 106, and 108 including the motor M and a conventional intercom unit 118 mounted on the inner surface of the bottom rail leg 54. A customer activated call button 120 including a speaker containing frame 122, is supported by the lower rail leg 54.

The unit 10 is conventionally mounted at a selected elevation on a support post 124 by a plurality of bolts 126 or the like.

Obviously the invention is susceptible to changes or alterations without defeating its practicability. Therefore, I do not wish to be confined to the preferred embodiment shown in the drawings and described herein.

I claim:

1. A drive-by restaurant menu order stand, comprising:

an upright housing means having a frame including upper and lower limits, a rearward bifurcated end wall, a forward part-cylindrical translucent end wall and forwardly converging translucent opposite side walls tangentially merging with said part-cylindrical end wall;

a floor adjacent the lower limit of the frame;

an upright cylinder within said part-cylindrical end wall;

cylinder angular rotating means axially mounted on a shaft vertically journaled by said floor;

a lamp within said cylinder;

a motor drivably connected with said cylinder rotating means;

and, a source of electrical energy operatively connected with said motor and said lamp for energizing said lamp and angularly rotating said cylinder.

2. The restaurant order stand according to claim 1 in which the housing means further includes:

an overlying top;

a bottom;

a bottom rail joining said bottom to the floor; and, customer responsive intercom supported by the bottom rail.

3. The restaurant order stand according to claim 2 in which the frame further includes:

an upright partition adjacent the part-cylindrical end wall forming a lamp compartment; and, a plurality of lamps in said lamp compartment and connected with said source of electrical energy.

4. The restaurant order stand according to claim 3 and further including:

a lid overlying the part-circular end wall under said top;

a plurality of circumferentially spaced pins depending from said lid and journaling a like plurality of bearings spaced about a periphery of a upper end portion of said cylinder.

* * * * *